US011609523B2

(12) United States Patent
Adachi

(10) Patent No.: US 11,609,523 B2
(45) Date of Patent: Mar. 21, 2023

(54) IMAGE FORMING APPARATUS

(71) Applicant: FUJIFILM Business Innovation Corp., Tokyo (JP)

(72) Inventor: Yuichi Adachi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/409,742

(22) Filed: Aug. 23, 2021

(65) Prior Publication Data

US 2022/0269209 A1 Aug. 25, 2022

(30) Foreign Application Priority Data

Feb. 24, 2021 (JP) ..... JP2021-027958

(51) Int. Cl.
*G03G 15/00* (2006.01)
*G03G 21/16* (2006.01)

(52) U.S. Cl.
CPC ..... *G03G 15/6514* (2013.01); *G03G 21/1695* (2013.01); *G03G 2215/00392* (2013.01)

(58) Field of Classification Search
CPC ..... G03G 15/6514; G03G 21/1695; G03G 2215/00392; B65H 2402/10; B65H 2405/1117; B65H 2405/1134; B65H 2405/31; B65H 2405/325; B65H 2601/324
See application file for complete search history.

(56) References Cited

U.S. PATENT DOCUMENTS 6,267,368 B1 * 7/2001 Tomoe ..... G03G 15/234 271/301
7,931,263 B2 4/2011 Takahagi et al.
8,702,091 B2 * 4/2014 Schmidt ..... B65H 11/002 271/152
8,857,808 B2 * 10/2014 Matsumoto ..... B65H 1/04 271/127
2011/0291348 A1 * 12/2011 Kaiping ..... B65H 3/042 271/10.01

FOREIGN PATENT DOCUMENTS

JP 2007320755 12/2007
JP 2017057048 3/2017

* cited by examiner

*Primary Examiner* — Justin N Olamit
(74) *Attorney, Agent, or Firm* — JCIPRNET

(57) ABSTRACT

An image forming apparatus includes an image forming unit that forms an image on a recording medium and an image forming apparatus body in which the image forming unit is provided, and on which a first manual feeding tray and a second manual feeding tray having a configuration different from the first manual feeding tray are selectively mountable at a same mounting position.

11 Claims, 12 Drawing Sheets

IMAGE FORMING APPARATUS

CROSS-REFERENCE TO RELATED APPLICATIONS

This application is based on and claims priority under 35 USC 119 from Japanese Patent Application No. 2021-027958 filed Feb. 24, 2021.

BACKGROUND

(i) Technical Field

The present invention relates to an image forming apparatus.

(ii) Related Art

JP2017-57048A discloses an image forming apparatus including an openable and closable manual feeding tray, the image forming apparatus further including a tray bottom plate that is movable in one direction in order to stack media to be recorded and a protrusion unit that moves the tray bottom plate in the one direction with an operation of closing the manual feeding tray.

SUMMARY

As the image forming apparatus, an image forming apparatus in which it is possible to selectively mount a first manual feeding tray and a second manual feeding tray having a configuration different from the first manual feeding tray at different mounting positions on the image forming apparatus body is considered. Since it is necessary to provide structures for mounting the manual feeding trays at a plurality of positions, the configuration of the image forming apparatus is complicated.

Aspects of non-limiting embodiments of the present disclosure relate to an image forming apparatus that increases a degree of freedom in selecting a manual feeding tray to be mounted on the image forming apparatus body with a simpler configuration than a configuration where it is possible to mount the first manual feeding tray and the second manual feeding tray at different mounting positions on the image forming apparatus body.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including an image forming unit that forms an image on a recording medium and an image forming apparatus body in which the image forming unit is provided, and on which a first manual feeding tray and a second manual feeding tray having a configuration different from the first manual feeding tray are selectively mountable at a same mounting position.

BRIEF DESCRIPTION OF THE DRAWINGS

Exemplary embodiment(s) of the present invention will be described in detail based on the following figures, wherein.

DETAILED DESCRIPTION

Hereinafter, an example of an exemplary embodiment according to the present invention will be described based on the drawings.

Image Forming Apparatus 10

Figure 1:
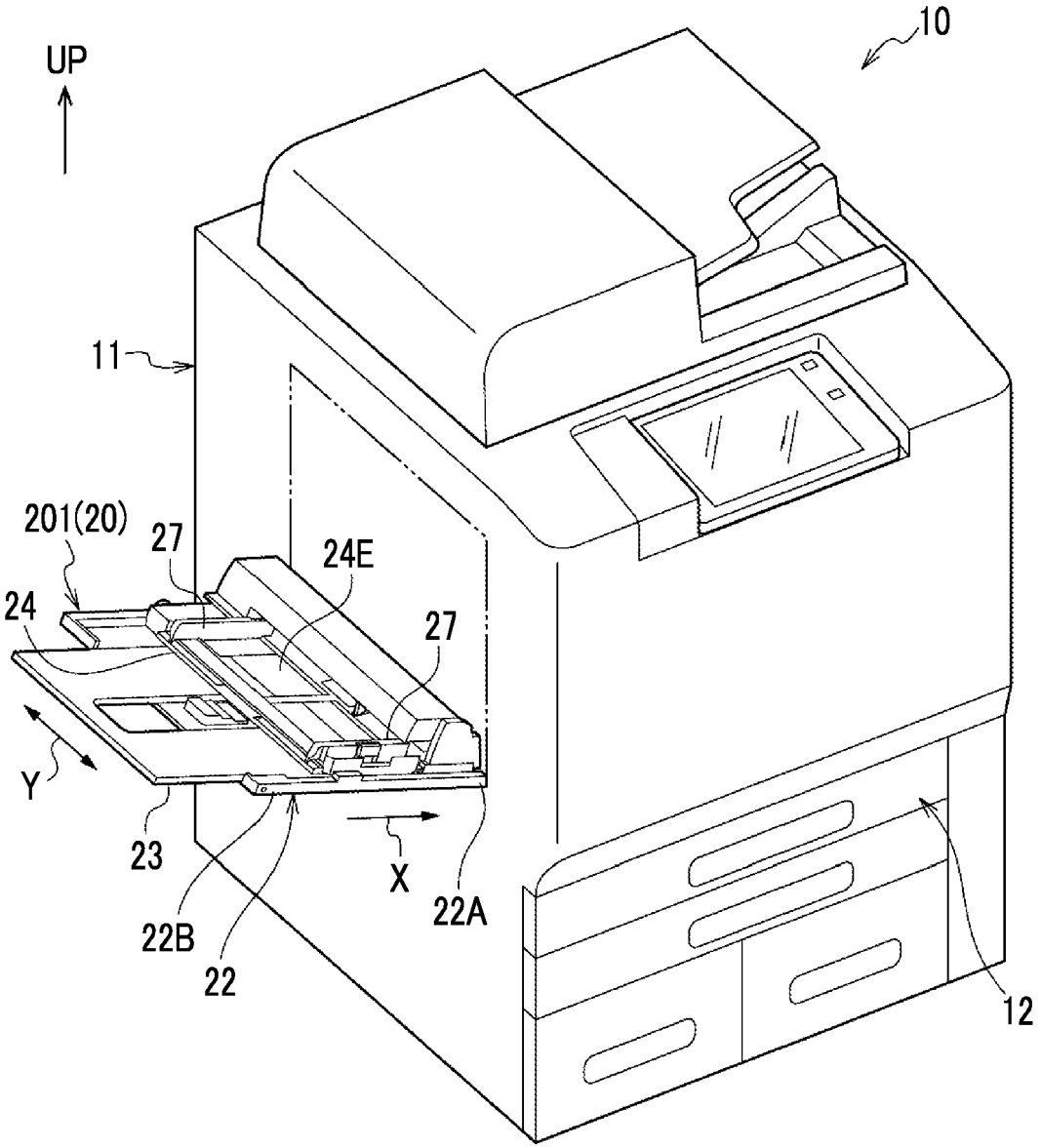
FIG. 1 is a perspective view illustrating an image forming apparatus according to the present exemplary embodiment.
Figure 2:
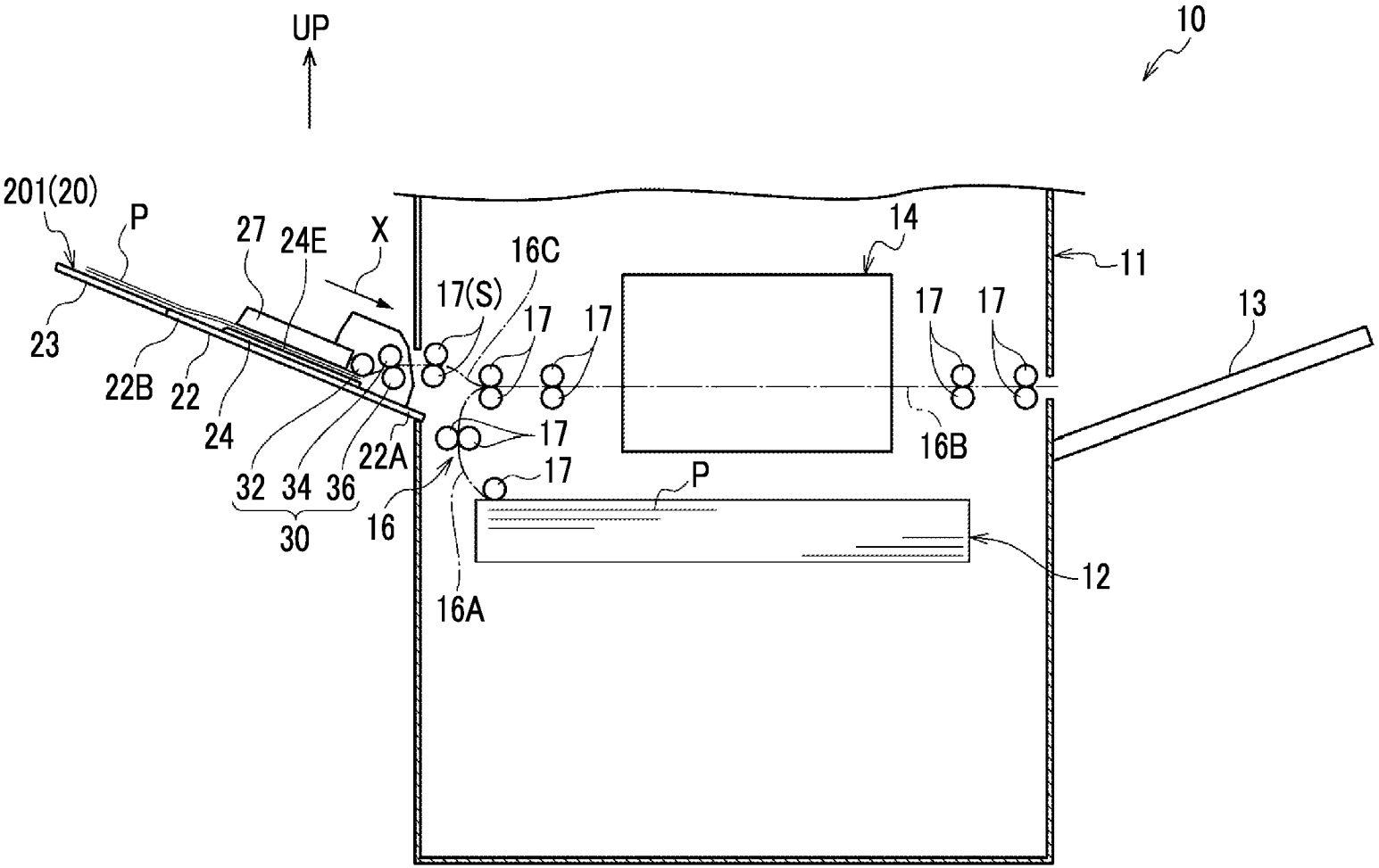
FIG. 2 is a regular cross-sectional view illustrating the image forming apparatus according to the present exemplary embodiment.

An image forming apparatus 10 according to the present exemplary embodiment will be described. FIG. 1 is a perspective view illustrating the image forming apparatus 10. FIG. 2 is a regular cross-sectional view illustrating the image forming apparatus 10. An arrow UP illustrated in each of the drawings including FIGS. 1 and 2 indicates an upper side (a vertically upper side) of the apparatus.

The image forming apparatus 10 illustrated in FIGS. 1 and 2 is an apparatus that forms an image. Specifically, as illustrated in FIGS. 1 and 2, the image forming apparatus 10 includes an image forming apparatus body 11 and a medium accommodating unit 12. In addition, as illustrated in FIG. 2, the image forming apparatus 10 includes a medium discharged portion 13, an image forming unit 14, and a transporting mechanism 16. Hereinafter, each unit of the image forming apparatus 10 will be described.

Image Forming Apparatus Body 11

The image forming apparatus body 11 illustrated in FIGS. 1 and 2 is a portion where each configuration unit of the image forming apparatus 10 is provided. Specifically, the image forming apparatus body 11 has a frame 15 that forms the skeleton of the image forming apparatus 10 as illustrated in FIG. 3 and a housing 19 formed in a substantially rectangular parallelepiped shape as illustrated in FIG. 1.

Figure 3:
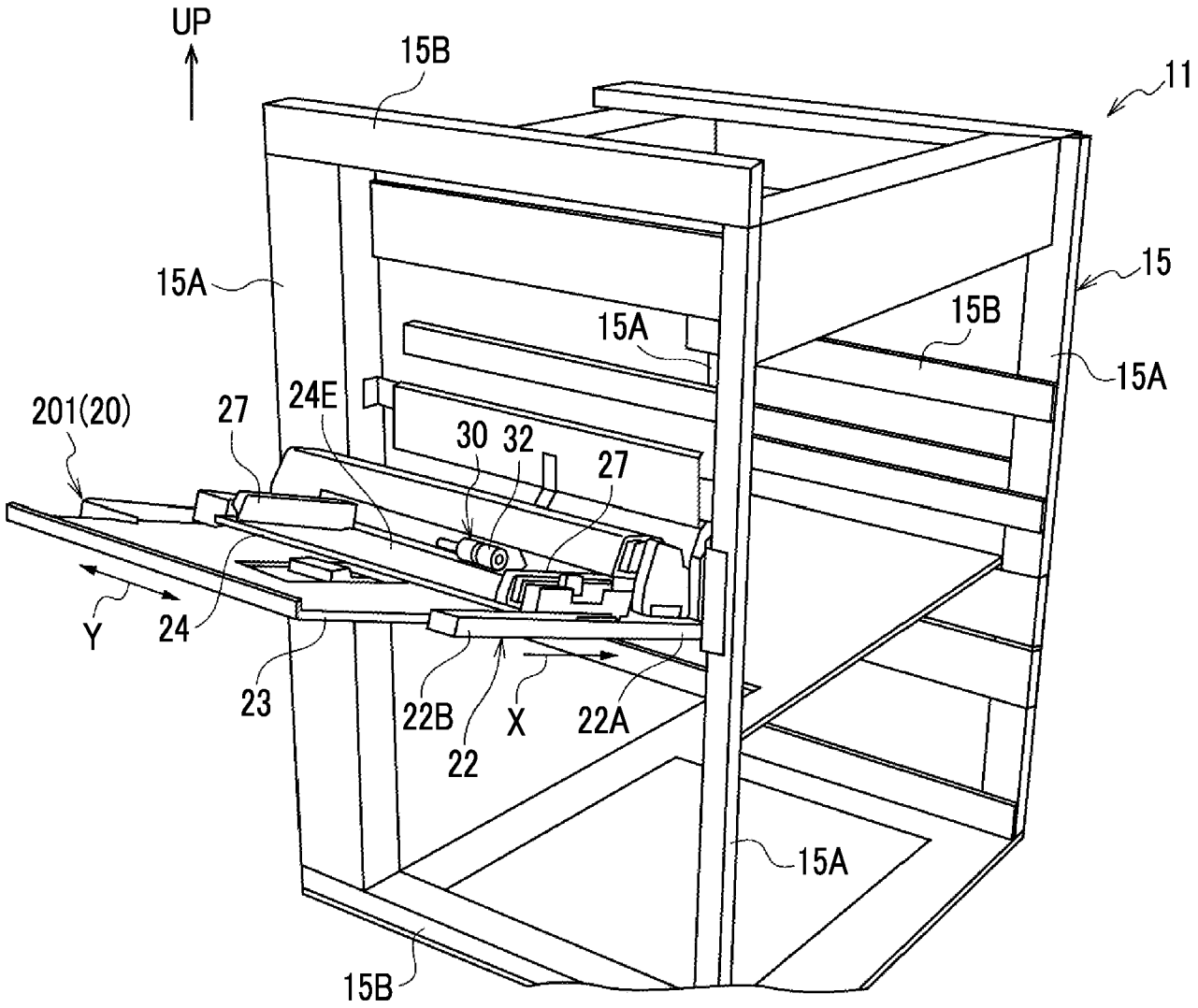
FIG. 3 is a perspective view illustrating a first manual feeding tray according to the present exemplary embodiment, which is in a state of being mounted on a frame.

As illustrated in FIG. 3, the frame 15 has four columns 15A that extend in an up-and-down direction and connecting members 15B that extend in a direction intersecting the up-and-down direction and connect the columns 15A to each other. The frame 15 is formed in a substantially rectangular parallelepiped shape. Each configuration unit of the image forming apparatus 10 is mounted on the frame 15, and the frame functions as a support body that supports each configuration unit.

The housing 19 is arranged on an outer side of the frame 15 to surround the frame 15. Therefore, the housing 19 can also be called an exterior cover that surrounds the frame 15.

As illustrated in FIG. 2, in the present exemplary embodiment, for example, the medium accommodating unit 12, the image forming unit 14, and the transporting mechanism 16 are provided inside the image forming apparatus body 11 (specifically, the housing 19). The medium discharged portion 13 is provided on one side surface of the image forming apparatus body 11 (specifically, the housing 19).

It is possible to selectively mount a first manual feeding tray 201 (see FIGS. 1 to 3) and a second manual feeding tray 202 (see FIG. 8) having a configuration different from the first manual feeding tray 201 at the same mounting position on the other side surface of the image forming apparatus body 11. Specifically, it is possible to mount the first manual feeding tray 201 (see FIG. 3) and the second manual feeding tray 202 (see FIG. 8) at the same mounting position on the frame 15.

Figure 8:
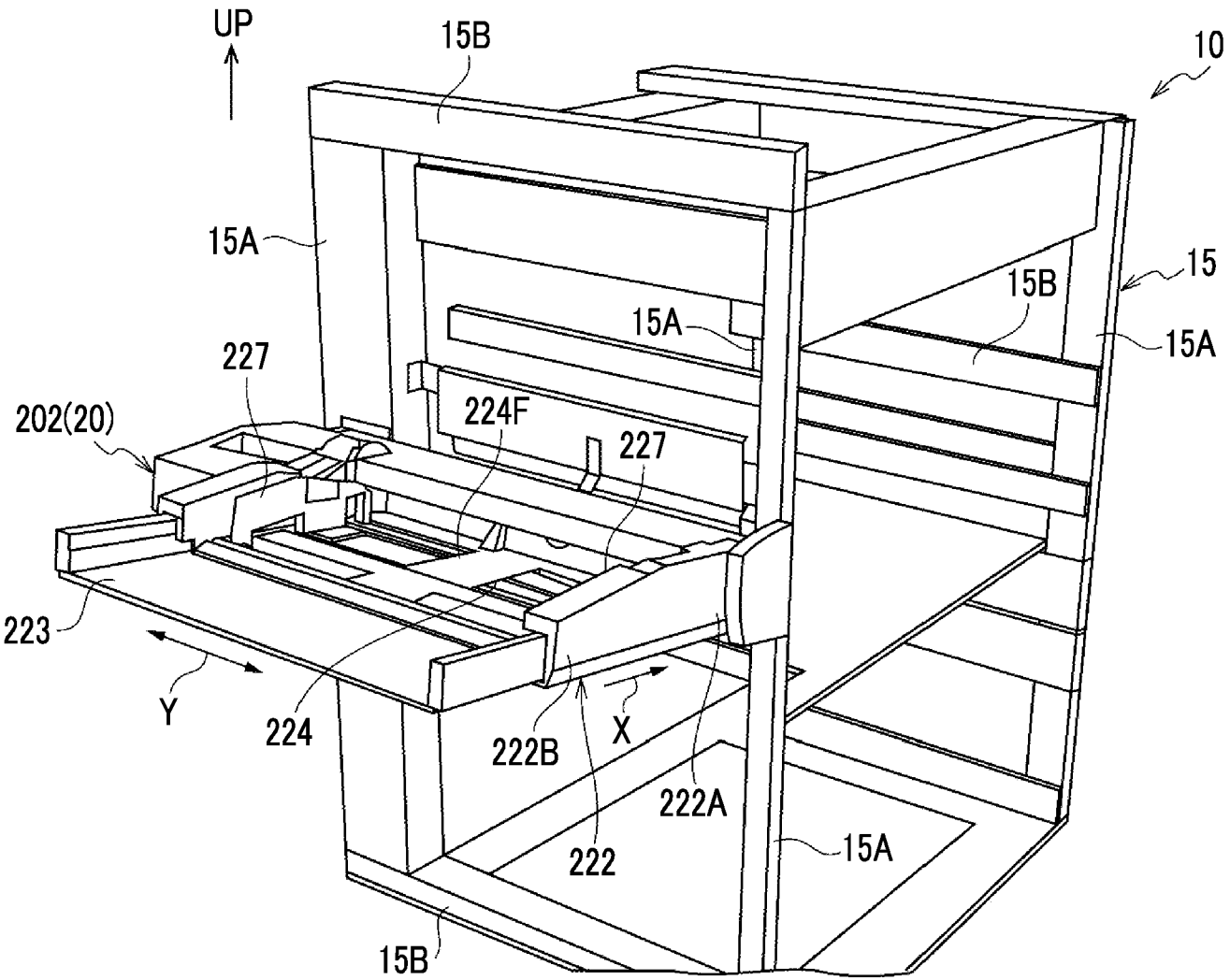
FIG. 8 is a perspective view illustrating the second manual feeding tray according to the present exemplary embodiment, which is in a state of being mounted on the frame.

FIGS. 1 to 3 illustrate a configuration in a case where the first manual feeding tray 201 is mounted on the image forming apparatus body 11 (specifically, the frame 15). FIG. 8 illustrates a configuration in a case where the second manual feeding tray 202 is mounted on the image forming apparatus body 11 (specifically, the frame 15).

Hereinafter, the first manual feeding tray 201 and the second manual feeding tray 202 will be collectively called the manual feeding tray 20 in some cases. In addition, specific configurations of the first manual feeding tray 201 and the second manual feeding tray 202 will be described later.

Medium Accommodating Unit 12

As illustrated in FIG. 2, the medium accommodating unit of the image forming apparatus 10 is a portion that accommodates a recording medium P. The recording medium P accommodated in the medium accommodating unit 12 is supplied to the image forming unit 14. As the recording medium P, for example, paper P is used.

Medium Discharged Portion 13

The medium discharged portion 13 of the image forming apparatus 10, which is illustrated in FIG. 2, is a portion to which the recording medium P is discharged. The recording medium P on which an image is formed by the image forming unit 14 is discharged to the medium discharged portion 13.

Image Forming Unit 14

The image forming unit 14 illustrated in FIG. 2 has a function of forming an image on the recording medium P fed from the first manual feeding tray 201 or the second manual feeding tray 202, which is mounted on the image forming apparatus body 11, and the medium accommodating unit 12. Examples of the image forming unit 14 include an inkjet image forming unit that forms an image on the recording medium P using inks and an electrophotographic image forming unit that forms an image on the recording medium P using toners.

In the inkjet image forming unit, for example, ink droplets are jetted to the recording medium P from a jetting unit, and an image is formed on the recording medium P. The inkjet image forming unit may form an image on the recording medium P as the jetting unit jets ink droplets to a transfer body and the ink droplets are transferred from the transfer body to the recording medium P.

The electrophotographic image forming unit performs, for example, each of processes such as charging, exposing, developing, transferring, and fixing, and forms an image on the recording medium P. After the image is formed on the transfer body by performing each of the processes, such as charging, exposing, developing, and transferring, and the image is transferred from the transfer body to the recording medium P, the electrophotographic image forming unit may form the image on the recording medium P by fixing the image to the recording medium P.

Examples of the image forming unit are not limited to the inkjet image forming unit described above and the electrophotographic image forming unit described above, and various image forming units can be used.

Transporting Mechanism 16

The transporting mechanism 16 illustrated in FIG. 2 is a mechanism that transports the recording medium P. The transporting mechanism 16 transports the recording medium P, for example, with a transporting member 17 such as a transporting roller. The transporting member 17 may be a transporting belt, and may be any member that applies a transporting force to the recording medium P and can transport the recording medium P.

The transporting mechanism 16 has a transporting passage 16A, which is formed in the image forming apparatus body 11 and through which the recording medium P is transported from the medium accommodating unit 12 to the image forming unit 14. In the transporting mechanism 16, the transporting member 17 arranged on the transporting passage 16A transports the recording medium P from the medium accommodating unit 12 to the image forming unit 14.

In addition, the transporting mechanism 16 has a transporting passage 16B, which is formed in the image forming apparatus body 11 and through which the recording medium P is transported from the image forming unit 14 to the medium discharged portion 13. In the transporting mechanism 16, the transporting member 17 arranged on the transporting passage 16B transports the recording medium P from the image forming unit 14 to the medium discharged portion 13.

Further, the transporting mechanism 16 has a transporting passage 16C, which is formed in the image forming apparatus body 11 and through which the recording medium P fed from the first manual feeding tray 201 or the second manual feeding tray 202, which is mounted on the image forming apparatus body 11, is transported to the image forming unit 14. In the transporting mechanism 16, the transporting member 17 arranged on the transporting passage 16C transports the recording medium P, which is fed from the first manual feeding tray 201 or the second manual feeding tray 202, to the image forming unit 14.

In the present exemplary embodiment, the recording medium P, which is fed from the first manual feeding tray 201, or the recording medium P, which is fed from the second manual feeding tray 202, is transported to the image forming unit 14 on the same path in the transporting passage 16C.

In addition, a transporting member 17 (S) arranged on the most upstream side in the transporting passage 16C transports the recording medium P in a transporting direction with a horizontal or downward slope. In the present exemplary embodiment, the transporting member 17(S) transports the recording medium in a transporting direction H1 (see FIG. 12) with a slightly downward slope.

Outline of Manual Feeding Tray 20

Herein, the outline of the manual feeding tray 20 (that is, the first manual feeding tray 201 and the second manual feeding tray 202) will be described.

Figure 4:
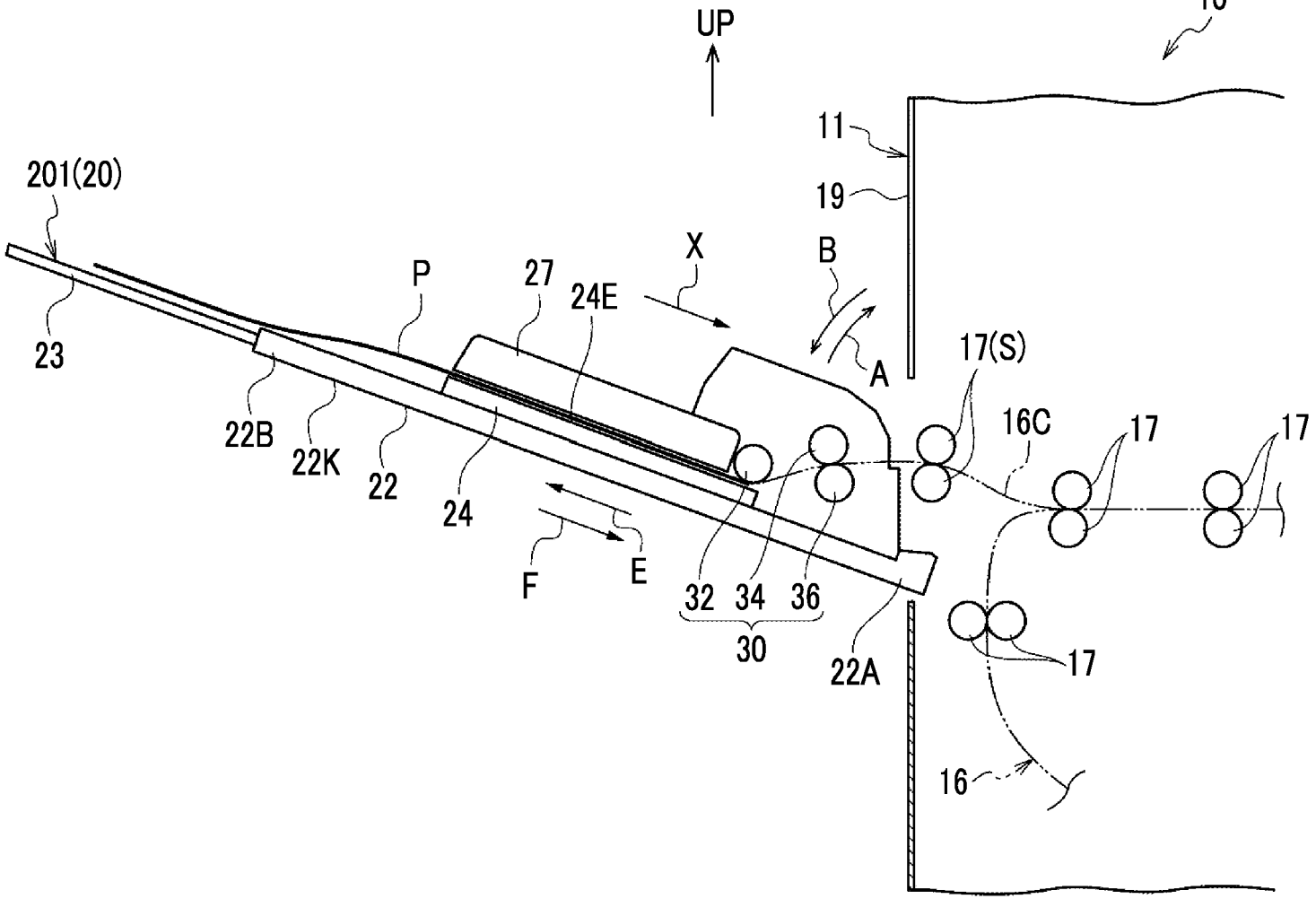
FIG. 4 is a side-sectional view of the first manual feeding tray according to the present exemplary embodiment.
Figure 9:
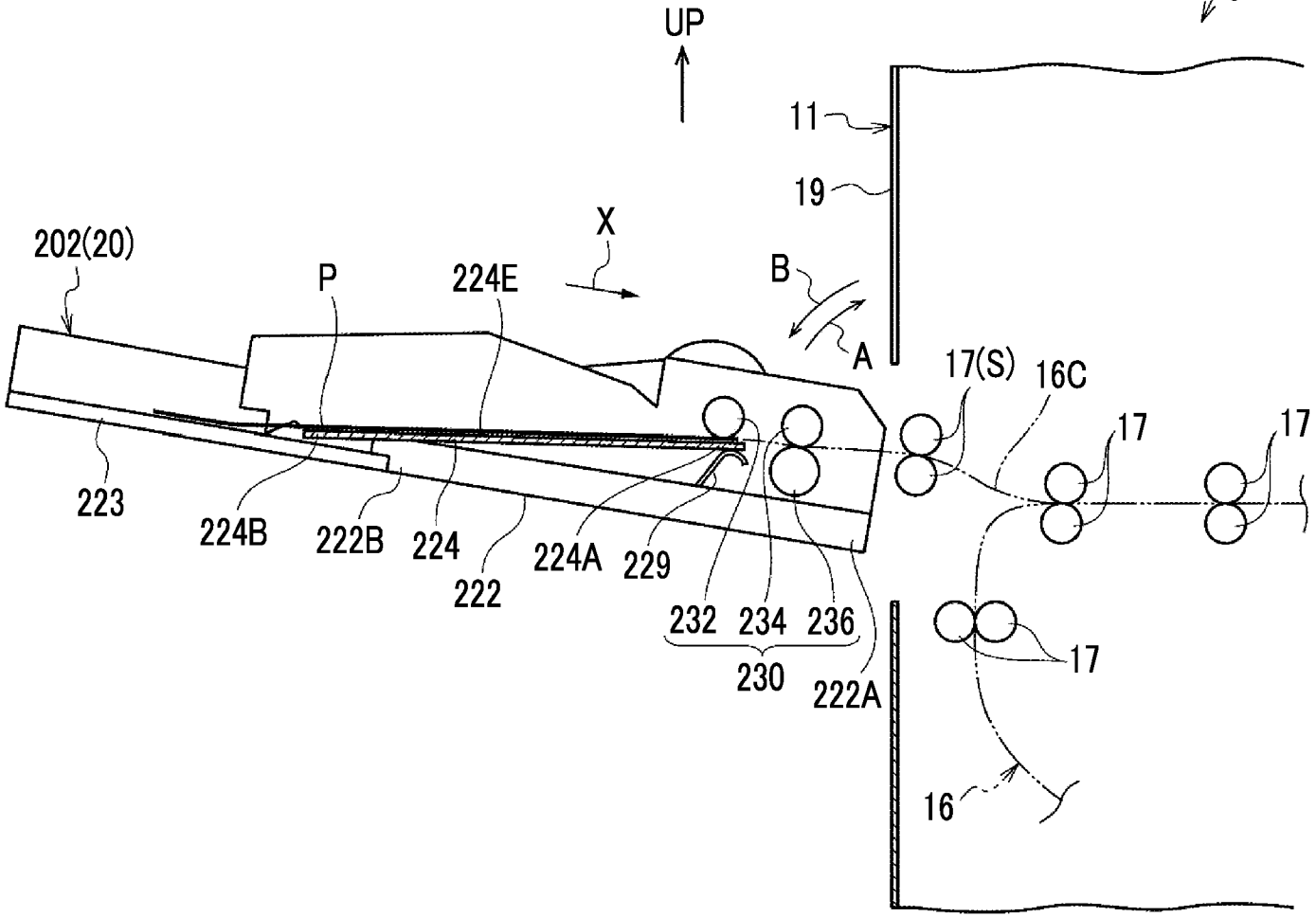
FIG. 9 is a side-sectional view of the second manual feeding tray according to the present exemplary embodiment.

The manual feeding tray 20 of the image forming apparatus 10 is a portion on which the recording media P are stacked (see FIGS. 2, 4, and 9). The tray means a member on which the recording media P are stacked. Manual feeding means an operation of manually stacking the recording media P by a user of the image forming apparatus 10. Therefore, the manual feeding tray 20 means a member on which the recording media P are manually stacked by the user of the image forming apparatus 10.

In addition, as described above, the manual feeding tray 20 is mounted on the image forming apparatus body 11. On the manual feeding tray 20, the recording media P are stacked in a state of being exposed to the outside of the image forming apparatus body 11.

Further, the manual feeding tray 20 functions as, for example, a feeding device that feeds the recording medium P of a type which cannot be fed from the medium accommodating unit 12 or which is not appropriate for being fed from the medium accommodating unit 12. The type includes cardboard, postcards, envelopes, non-standard size paper, and resin films.

A feeding direction in which the recording medium P is fed from the manual feeding tray 20 is indicated by an arrow X direction in each drawing. In addition, a direction intersecting (specifically, orthogonal to) the feeding direction is indicated by an arrow Y direction in each drawing.

First Manual Feeding Tray 201

Figure 5:
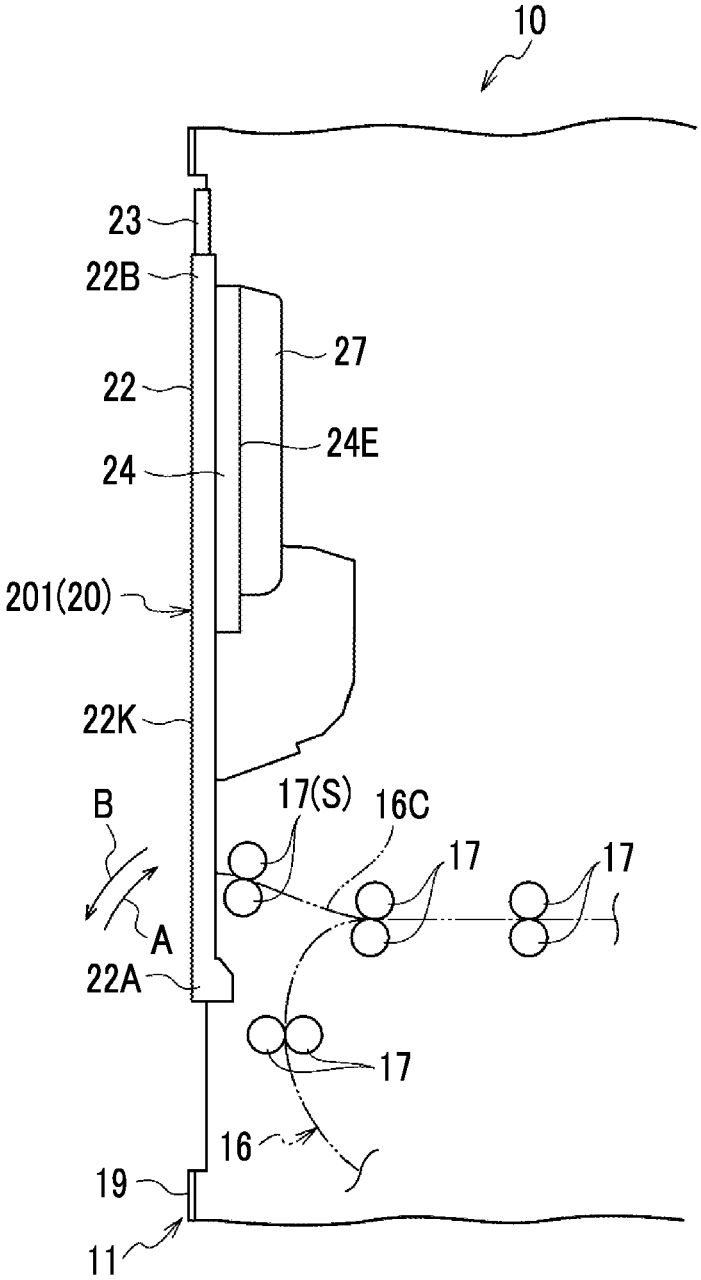
FIG. 5 is a side-sectional view illustrating the first manual feeding tray according to the present exemplary embodiment, which is in a state of being positioned at a closed position.
Figure 6:
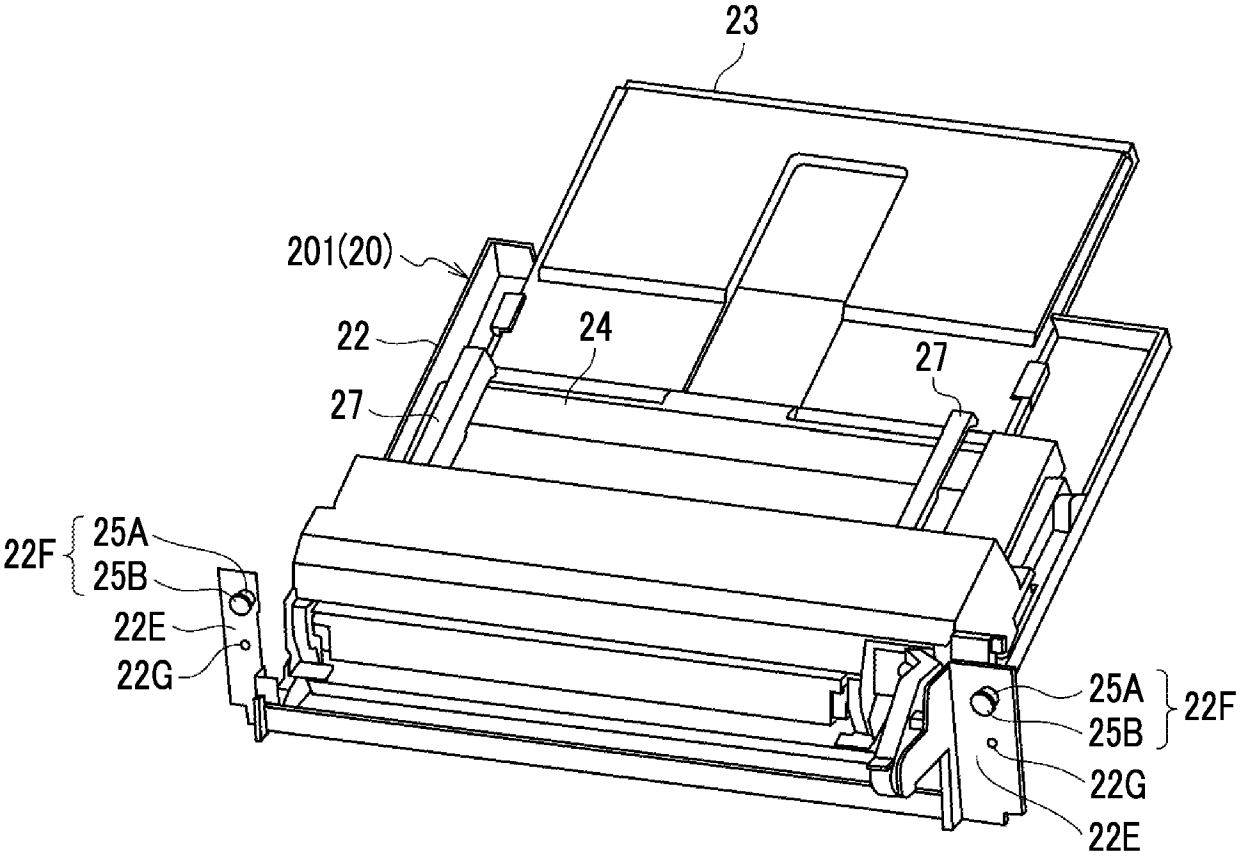
FIG. 6 is a perspective view illustrating the first manual feeding tray according to the present exemplary embodiment.
Figure 7:
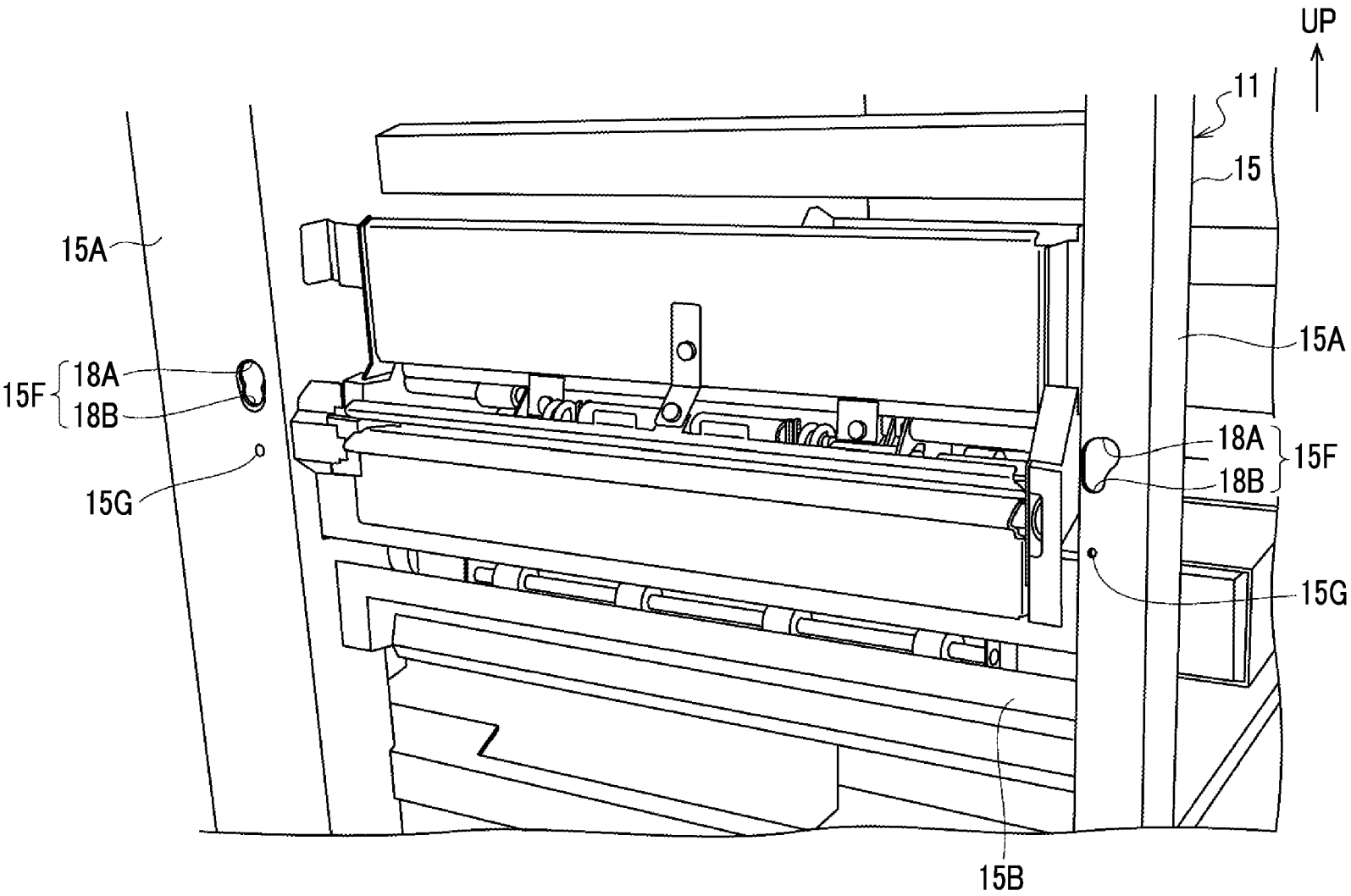
FIG. 7 is a perspective view illustrating a mounting position on the frame on which the first manual feeding tray and a second manual feeding tray according to the present exemplary embodiment are mounted.

FIG. 3 is a perspective view illustrating the first manual feeding tray 201 in a state of being mounted on the frame 15. FIG. 4 is a side-sectional view of the first manual feeding tray 201. FIG. 5 is a side-sectional view of the first manual feeding tray 201 in a state of being positioned at a closed position. FIG. 6 is a perspective view of the first manual feeding tray 201. FIG. 7 is a perspective view illustrating a mounting position on the frame 15 on which the first manual feeding tray 201 and the second manual feeding tray 202 are mounted.

As illustrated in FIGS. 3 and 4, the first manual feeding tray 201 includes a tray body 22, a stacked portion 24, and a feeding mechanism 30.

Tray Body 22

As illustrated in FIGS. 3 and 4, the tray body 22 is a portion where each configuration unit of the first manual feeding tray 201 is provided. As illustrated in FIGS. 3 to 5, a downstream end portion 22A of the tray body 22 in the feeding direction (the arrow X direction) is mounted on the image forming apparatus body 11.

As illustrated in FIG. 6, a mounting portion 22E, which is mounted on the frame 15, is provided at each of one end portion and the other end portion of the downstream end portion 22A of the tray body 22 in the intersecting direction (the arrow Y direction). A protruding portion 22F protruding to the downstream side in the feeding direction is formed on the mounting portion 22E. The protruding portion 22F has a shaft portion 25A and a head portion 25B having a diameter larger than the diameter of the shaft portion 25A. In addition, a through-hole 22G through which a fastening member (not illustrated) such as a bolt passes is formed below the protruding portion 22F of the mounting portion 22E.

On the other hand, as illustrated in FIG. 7, an insertion hole 15F into which the protruding portion 22F is inserted is formed in the column 15A of the frame 15. The insertion hole 15F has a large-diameter hole 18A having an inner diameter that is equal to or larger than the outer diameter of the head portion 25B of the protruding portion 22F and a small-diameter hole 18B having an inner diameter that is smaller than the outer diameter of the head portion 25B and is equal to or larger than the outer diameter of the shaft portion 25A. The small-diameter hole 18B is formed integrally with the large-diameter hole 18A below the large-diameter hole 18A. Further, a fastening hole 15G (specifically, for example, a screw hole), to which a fastening member (not illustrated) passed through the through-hole 22G is fastened, is formed below the insertion hole 15F.

In the present exemplary embodiment, the first manual feeding tray 201 is positioned with respect to the frame 15 by moving the protruding portion 22F downward such that each of the protruding portions 22F of the two mounting portions 22E is inserted into the large-diameter hole 18A of each insertion hole 15F of the frame 15 from the head portion 25B, and the shaft portion 25A of the protruding portion 22F is positioned in the small-diameter hole 18B. Then, as the fastening member (not illustrated) that has passed through each of the through-holes 22G of the two mounting portions 22E is fastened to the fastening hole 15G, the first manual feeding tray 201 is mounted on the image forming apparatus body 11.

In addition, in the present exemplary embodiment, as illustrated in FIGS. 4 and 5, an upstream end portion 22B of the tray body 22 is movable in a closing direction (an arrow A direction in FIGS. 4 and 5) and an opening direction (an arrow B direction in FIGS. 4 and 5) with the downstream end portion 22A as a fulcrum (that is, a rotation center).

Accordingly, in the present exemplary embodiment, the first manual feeding tray 201 is openable and closable between a closed position (a position illustrated in FIG. 5) where the upstream end portion 22B of the tray body 22 in the feeding direction is positioned above the downstream end portion 22A and an open position (a position illustrated in FIGS. 1 to 4) where the upstream end portion 22B of the tray body 22 is positioned on the side of the downstream end portion 22A. In addition, the tray body 22 may be configured such that the upstream end portion 22B is arranged at any position lower in the open position than in the closed position.

As illustrated in FIG. 5, in the closed position, the first manual feeding tray 201 is stored inside the image forming apparatus body 11 (specifically, the housing 19). Therefore, in the closed position, a bottom surface 22K of the tray body 22 of the first manual feeding tray 201 is arranged at a position along the side surface of the housing 19.

An extension portion 23 which can be pulled out from the tray body 22 to the upstream side in the feeding direction is provided at the tray body 22. By pulling out the extension portion 23 from the tray body 22 to the upstream side in the feeding direction, a region where the recording media P can be stacked is extended.

Stacked Portion 24

The stacked portion 24 is a portion on which the recording media P are stacked. As illustrated in FIGS. 3 and 4, the stacked portion 24 is provided on an inner side (a closing direction (the arrow A direction in FIGS. 4 and 5) side of the tray body 22) of the tray body 22 movably along the tray body 22. Specifically, the stacked portion 24 is movable in a separating direction (an arrow E direction in FIG. 4) in which the stacked portion separates from the downstream end portion 22A (that is, the rotation center) of the tray body 22 to the upstream end portion 22B (that is, a free end) and an approaching direction (an arrow F direction in FIG. 4), which is an opposite direction thereof.

In the present exemplary embodiment, a link mechanism (not illustrated) moves the stacked portion 24 in the separating direction and the approaching direction in a movement range determined in advance with the opening and closing operation of the tray body 22. Specifically, the stacked portion 24 is positioned at a separated position (a position illustrated in FIG. 5) in a state where the tray body 22 is positioned at the closed position, and moves from the separated position to an approached position (a position illustrated in FIG. 4) in a case where the tray body 22 is rotated from the closed position to the open position.

The stacked portion 24 is formed in a plate shape (flat shape) of which a thickness direction is the closing direction (the arrow A direction in FIGS. 4 and 5) of the tray body 22. As illustrated in FIGS. 3 and 4, in a state where the tray body 22 is positioned at the open position, a stack surface 24E of the stacked portion 24, on which the recording media P are stacked, is exposed. Therefore, the recording media P are stacked on the stacked portion 24 in a state of being exposed to the outside of the image forming apparatus body 11. In addition, the recording media P are stacked in a posture with a downward slope with respect to the stacked portion 24 toward the downstream side in the feeding direction.

In addition, the stacked portion 24 does not move in a thickness direction (that is, the closing direction (the arrow A direction in FIGS. 4 and 5)) of the tray body 22, and the position of the stack surface 24E in a height direction is fixed with respect to the tray body 22.

For example, 150 recording media P can be stacked on the stacked portion 24 in the present exemplary embodiment. That is, a maximum stacked capacity of the first manual feeding tray 201 for the recording media P is, for example, 150 sheets.

Depending on the size of the recording medium P, there are a case where the entire recording medium P is stacked on the stacked portion 24 and a case where a part of the recording medium P is stacked on the stacked portion 24 and the other part is stacked on the tray body 22 (including the extension portion 23).

In addition, side guides 27 that come into contact with both side end portions of the recording media P stacked on the stacked portion 24, respectively, are provided on the stacked portion 24 (see FIG. 3). The side guides 27 are movable in the intersecting direction.

Feeding Mechanism 30

The feeding mechanism 30 illustrated in FIG. 4 is a mechanism that feeds the recording media P stacked on the stacked portion 24 from the stacked portion 24. Specifically, the feeding mechanism 30 transports the recording medium P, which is fed from the stacked portion 24, to the image forming apparatus body 11. Therefore, the feeding mechanism 30 can also be called a supply mechanism that supplies the recording medium P to the image forming apparatus body 11. As illustrated in FIG. 4, the feeding mechanism 30 has a feeding roller 32, a transporting roller 34, and an applying roller 36. The feeding mechanism 30 is an example of a "feeding unit". The applying roller 36 is an example of a "facing roller".

By rotating while coming into contact with a portion of the front surface of the recording medium P positioned uppermost, which is on a downstream side in the feeding direction, among the recording media P stacked on the stacked portion 24, the feeding roller 32 feeds the recording medium P from the stacked portion 24. The feeding roller 32 is a roller which is also called a pickup roller or a nudger roller.

As illustrated in FIG. 4, the transporting roller 34 is arranged on the downstream side in the feeding direction with respect to the feeding roller 32. The applying roller 36 is arranged to face the transporting roller 34. Specifically, the applying roller 36 is arranged below the transporting roller 34, and is in contact with the transporting roller 34. By being rotationally driven, the transporting roller 34 further transports the recording medium P fed by the feeding roller 32 to the downstream side in the feeding direction with the recording medium pinched between the applying roller 36 and the transporting roller. Specifically, the transporting roller 34 and the applying roller 36 feed the recording medium P from the stacked portion 24 in a first feeding direction S1 (see FIG. 12) with an upward slope toward the downstream side in the feeding direction.

A position where the recording medium is pinched between the transporting roller 34 and the applying roller 36 will be hereinafter referred to as a nip position. The nip position is an example of a "pinching position". In addition, the transporting roller 34 is a roller which is also called a feed roller.

The applying roller 36 is a roller that is driven to rotate in a case where a rotational force determined in advance is applied, and functions as a brake that generates a rotational load until the rotational force determined in advance is applied. In a case where a plurality of recording media P overlap each other and are introduced to the nip position, the applying roller 36 applies a transporting resistance from the back surface side of the recording medium P as the applying roller 36 functions as the brake as described above, preventing double feeding of the recording media P transported by the transporting roller 34. The applying roller 36 is a roller which is also called a retard roller.

In a case where the feeding mechanism 30 feeds the plurality of recording media P, which are overlapping each other, from the stacked portion 24 as described above, the transporting roller 34 applies a transporting force to the upper recording medium P (that is, the first recording medium P), while the applying roller 36 applies a transporting resistance to the lower recording medium P (the second and subsequent recording media P). That is, the sheets of paper P overlapping each other are separated (detached) by the transporting roller 34 and the applying roller 36, and the feeding mechanism 30 feeds the recording media P one by one.

Second Manual Feeding Tray 202

Figure 10:
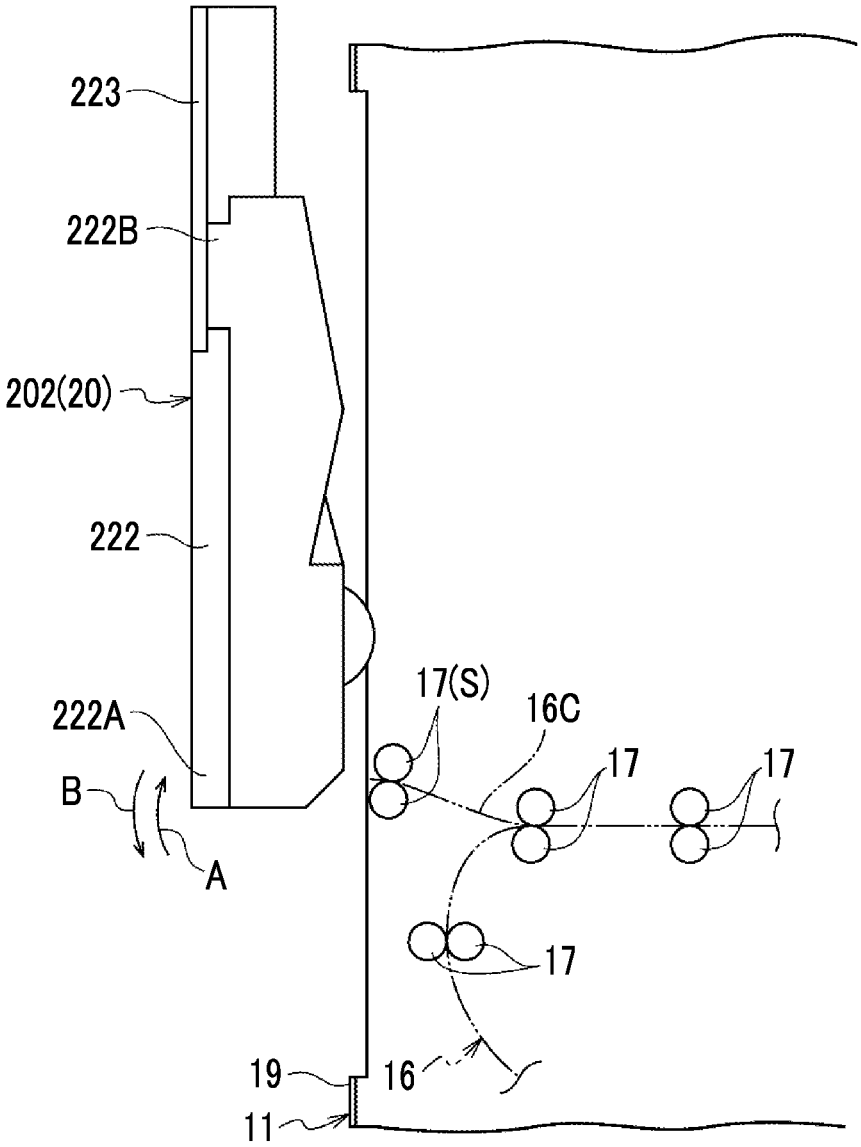
FIG. 10 is a side-sectional view illustrating the second manual feeding tray according to the present exemplary embodiment, which is in a state of being positioned at the closed position.
Figure 11:
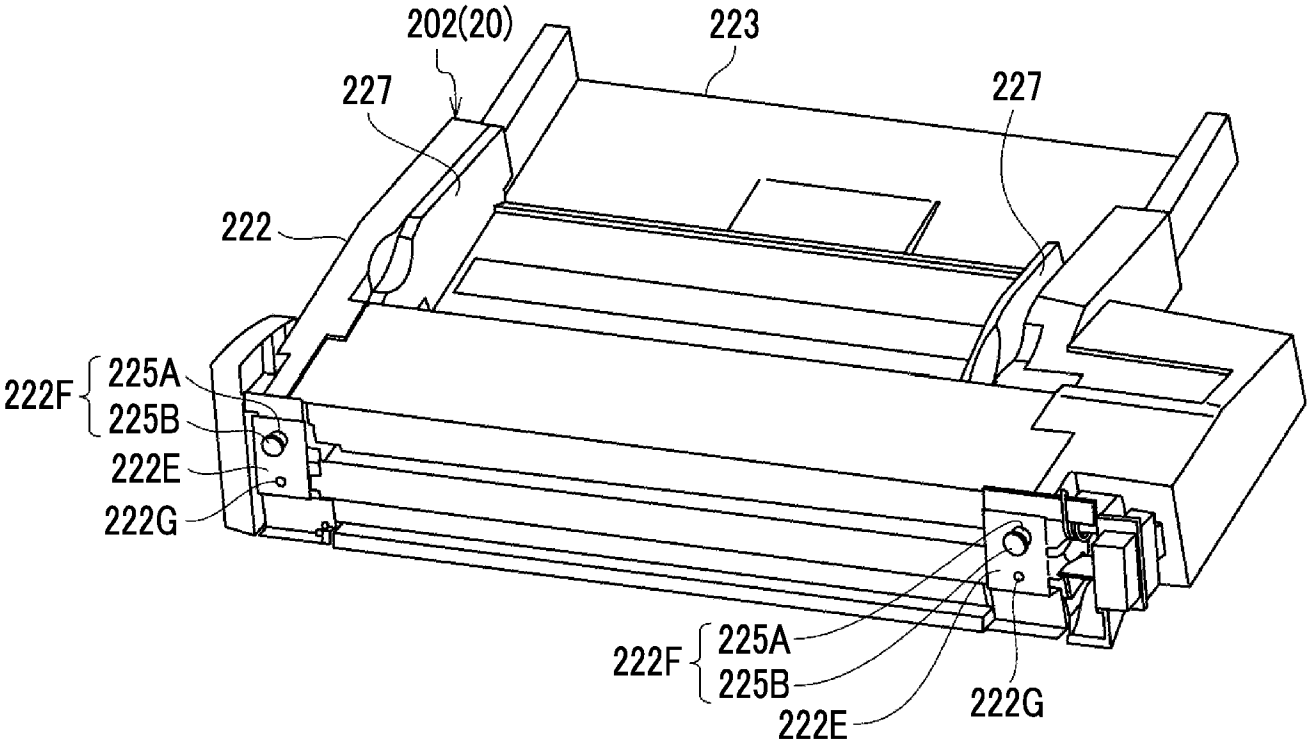
FIG. 11 is a perspective view illustrating the second manual feeding tray according to the present exemplary embodiment.

FIG. 8 is a perspective view illustrating the second manual feeding tray 202 in a state of being mounted on the frame 15. FIG. 9 is a side-sectional view of the second manual feeding tray 202. FIG. 10 is a side-sectional view of the second manual feeding tray 202 in a state of being positioned at the closed position. FIG. 11 is a perspective view of the second manual feeding tray 202.

As illustrated in FIGS. 8 and 9, the second manual feeding tray 202 includes a tray body 222, a stacked portion 224, and a feeding mechanism 230 (see FIG. 9).

Tray Body 222

As illustrated in FIGS. 8 and 9, the tray body 222 is a portion where each configuration unit of the second manual feeding tray 202 is provided. As illustrated in FIGS. 8 to 10, a downstream end portion 222A of the tray body 222 in the feeding direction (the arrow X direction) is mounted on the image forming apparatus body 11.

As illustrated in FIG. 11, a mounting portion 222E, which is mounted on the frame 15, is provided at each of one end portion and the other end portion of the downstream end portion 222A of the tray body 222 in the intersecting direction (the arrow Y direction). A protruding portion 222F protruding to the downstream side in the feeding direction is formed on the mounting portion 222E. The protruding portion 222F has a shaft portion 225A and a head portion 225B having a diameter larger than the diameter of the shaft portion 225A. In addition, a through-hole 222G through which a fastening member (not illustrated) such as a bolt passes is formed below the protruding portion 222F of the mounting portion 222E.

In the present exemplary embodiment, the second manual feeding tray 202 is positioned with respect to the frame 15 by moving the protruding portion 222F downward such that each of the protruding portions 222F of the two mounting portions 222E is inserted into the large-diameter hole 18A of each insertion hole 15F of the frame 15 from the head portion 225B, and the shaft portion 225A of the protruding portion 222F is positioned in the small-diameter hole 18B. Then, as the fastening member (not illustrated) that has passed through each of the through-holes 222G of the two mounting portions 222E is fastened to the fastening hole 15G, the second manual feeding tray 202 is mounted on the image forming apparatus body 11.

As described above, the second manual feeding tray 202 is mounted with respect to the insertion hole 15F and the fastening hole 15G of the frame 15 like the first manual feeding tray 201. That is, it is possible to selectively mount the second manual feeding tray 202 and the first manual feeding tray 201 at the same mounting position on the image forming apparatus body 11. In other words, instead of the first manual feeding tray 201, the second manual feeding tray 202 can be mounted at the same mounting position on the image forming apparatus body 11.

Therefore, a positional relationship between the protruding portions 222F and the through-holes 222G of the two mounting portions 222E of the second manual feeding tray 202 is the same as a positional relationship between the protruding portions 22F and the through-holes 22G of the two mounting portions 22E of the first manual feeding tray 201. Specifically, for example, an interval between the protruding portions 222F of the two mounting portions 222E in the intersecting direction and an interval between the protruding portions 22F of the two mounting portions 22E in the intersecting direction are the same. In addition, an interval between the through-holes 222G of the two mounting portions 222E in the intersecting direction and an interval between the through-holes 22G of the two mounting portions 22E in the intersecting direction are the same. Further, an interval between the protruding portion 222F and the through-hole 222G of each of the two mounting portions 222E in the up-and-down direction and an interval between the protruding portion 22F and the through-hole 22G of each of the two mounting portions 22E in the up-and-down direction are the same.

In addition, the length of the tray body 222 of the second manual feeding tray 202 in the intersecting direction is larger than the length of the tray body 22 of the first manual feeding tray 201 in the intersecting direction. The two mounting portions 22E of the first manual feeding tray 201 are arranged on an outer side in the intersecting direction with respect to the tray body 22. That is, the tray body 22 is positioned between the two mounting portions 22E. On the other hand, the two mounting portions 222E of the second manual feeding tray 202 are arranged between one end portion and the other end portion of the tray body 222 in the intersecting direction.

In addition, in the second manual feeding tray 202, as illustrated in FIGS. 9 and 10, an upstream end portion 222B of the tray body 222 is movable in the closing direction (the arrow A direction in FIGS. 9 and 10) and the opening direction (the arrow B direction in FIGS. 9 and 10) with the downstream end portion 222A as a fulcrum (that is, a rotation center).

Accordingly, in the present exemplary embodiment, the second manual feeding tray 202 is openable and closable between a closed position (a position illustrated in FIG. 10) where the upstream end portion 222B of the tray body 222 in the feeding direction is positioned above the downstream end portion 222A and an open position (a position illustrated in FIGS. 8 and 9) where the upstream end portion 222B of the tray body 222 is positioned on the side of the downstream end portion 222A. In addition, the tray body 222 may be configured such that the upstream end portion 222B is arranged at any position lower in the open position than in the closed position.

As illustrated in FIG. 10, in the closed position, the second manual feeding tray 202 is positioned outside the image forming apparatus body 11 (specifically, the housing 19). Therefore, in the closed position, the positions of the second manual feeding tray 202 and the first manual feeding tray 201 (see FIG. 5), which is stored inside the image forming apparatus body 11 (specifically, the housing 19) in the closed position, are different from each other.

An extension portion 223 which can be pulled out from the tray body 222 to the upstream side in the feeding direction is provided at the tray body 222. By pulling out the extension portion 223 from the tray body 222 to the upstream side in the feeding direction, a region where the recording media P can be stacked is extended.

Stacked Portion 224

The stacked portion 224 is a portion on which the recording media P are stacked. Specifically, as illustrated in FIGS. 8 and 9, the stacked portion 224 is configured by a stacking plate provided on an inner side (the closing direction (the arrow A direction in FIGS. 9 and 10) side of the tray body 222) of the tray body 222.

An upstream end portion 224B of the stacked portion 224 is mounted on the tray body 222 such that a downstream end portion 224A is movable in the up-and-down direction (see FIG. 9). A pressing member 229 that presses the downstream end portion 224A upward with an elastic force applied to the pressing member is provided below the stacked portion 224.

As described above, since the stacked portion 224 of the second manual feeding tray 202 is pressed upward by the pressing member 229, a stack surface 224E on which the recording media P are stacked rises with a decrease in the number of stacked sheets. Therefore, the second manual feeding tray 202 is different from the first manual feeding tray 201 in which the position of the stack surface 24E in the height direction is fixed with respect to the tray body 22, and the position of the stack surface 224E in a height direction with respect to the tray body 222 changes.

In addition, while the recording media are stacked in a posture with a downward slope toward the downstream side in the feeding direction with respect to the stacked portion 24 in the first manual feeding tray 201, the recording medium P are stacked in a posture with an upward slope toward the downstream side in the feeding direction in the stacked portion 224 of the second manual feeding tray 202.

In addition, as illustrated in FIGS. 8 and 9, in a state where the tray body 222 is positioned at the open position, the stack surface 224E of the stacked portion 224 is exposed. Therefore, the recording media P are stacked on the stacked portion 224 in a state of being exposed to the outside of the image forming apparatus body 11.

For example, 250 recording media P can be stacked on the stacked portion 224 in the present exemplary embodiment. That is, the maximum stacked capacity of the second manual feeding tray 202 for the recording media P is, for example, 250 sheets. Therefore, the number of recording media that can be stacked on the second manual feeding tray 202 is larger than the number of recording media that can be stacked on the first manual feeding tray 201. In other words, the stacked height of the recording media P that can be stacked on the second manual feeding tray 202 is larger than the stacked height of the recording media that can be stacked on the first manual feeding tray 201.

Depending on the size of the recording medium P, there are a case where the entire recording medium P is stacked on the stacked portion 224 and a case where a part of the recording medium P is stacked on the stacked portion 224 and the other part is stacked on the tray body 222 (including the extension portion 223).

In addition, side guides 227 that come into contact with both side end portions of the recording media P stacked on the stacked portion 224, respectively, are provided on the stacked portion 224 (see FIG. 8). The side guides 227 are movable in the intersecting direction.

Feeding Mechanism 230

The feeding mechanism 230 illustrated in FIG. 9 is a mechanism that feeds the recording media P stacked on the stacked portion 224 from the stacked portion 224. Specifically, the feeding mechanism 230 transports the recording medium P, which is fed from the stacked portion 224, to the image forming apparatus body 11. Therefore, the feeding mechanism 230 can also be called a supply mechanism that supplies the recording medium P to the image forming apparatus body 11. As illustrated in FIG. 9, the feeding mechanism 230 has a feeding roller 232, a transporting roller 234, and an applying roller 236. The feeding mechanism 230 is an example of a "feeding unit". The applying roller 236 is an example of a "facing roller".

By rotating while coming into contact with a portion of the front surface of the recording medium P positioned uppermost, which is on the downstream side in the feeding direction, among the recording media P stacked on the stacked portion 224, the feeding roller 232 feeds the recording medium P from the stacked portion 224. The feeding roller 232 is a roller which is also called a pickup roller or a nudger roller.

As illustrated in FIG. 9, the transporting roller 234 is arranged on the downstream side in the feeding direction with respect to the feeding roller 232. The applying roller 236 is arranged to face the transporting roller 234. Specifically, the applying roller 236 is arranged below the transporting roller 234, and is in contact with the transporting roller 234. By being rotationally driven, the transporting roller 234 further transports the recording medium P fed by the feeding roller 232 to the downstream side in the feeding direction with the recording medium pinched between the applying roller 236 and the transporting roller. Specifically, the transporting roller 234 and the applying roller 236 feed the recording medium P from the stacked portion 224 in a second feeding direction S2 (see FIG. 12) with a downward slope toward the downstream side in the feeding direction.

A position where the recording medium is pinched between the transporting roller 234 and the applying roller 236 will be hereinafter referred to as a nip position. The nip position is an example of a "pinching position". In addition, the transporting roller 234 is a roller which is also called a feed roller.

The applying roller 236 is a roller that is driven to rotate in a case where a rotational force determined in advance is applied, and functions as a brake that generates a rotational load until the rotational force determined in advance is applied. In a case where the plurality of recording media P overlap each other and are introduced to the nip position, the applying roller 236 applies a transporting resistance from the back surface side of the recording medium P as the applying roller 236 functions as the brake as described above, preventing double feeding of the recording media P transported by the transporting roller 234. The applying roller 236 may be configured to apply a transporting resistance to the recording medium P by rotating reversely. In addition, the applying roller 236 is a roller which is also called a retard roller.

In a case where the feeding mechanism 230 feeds the plurality of recording media P, which are overlapping each other, from the stacked portion 224 as described above, the transporting roller 234 applies a transporting force to the upper recording medium P (that is, the first recording medium P), while the applying roller 236 applies a transporting resistance to the lower recording medium P (the second and subsequent recording media P). That is, the sheets of paper P overlapping each other are separated (detached) by the transporting roller 234 and the applying roller 236, and the feeding mechanism 230 feeds the recording media P one by one.

Differences Between Feeding Mechanism 30 and Feeding Mechanism 230

Herein, differences between the feeding mechanism 30 of the first manual feeding tray 201 and the feeding mechanism 230 of the second manual feeding tray 202 will be described.

Figure 12:
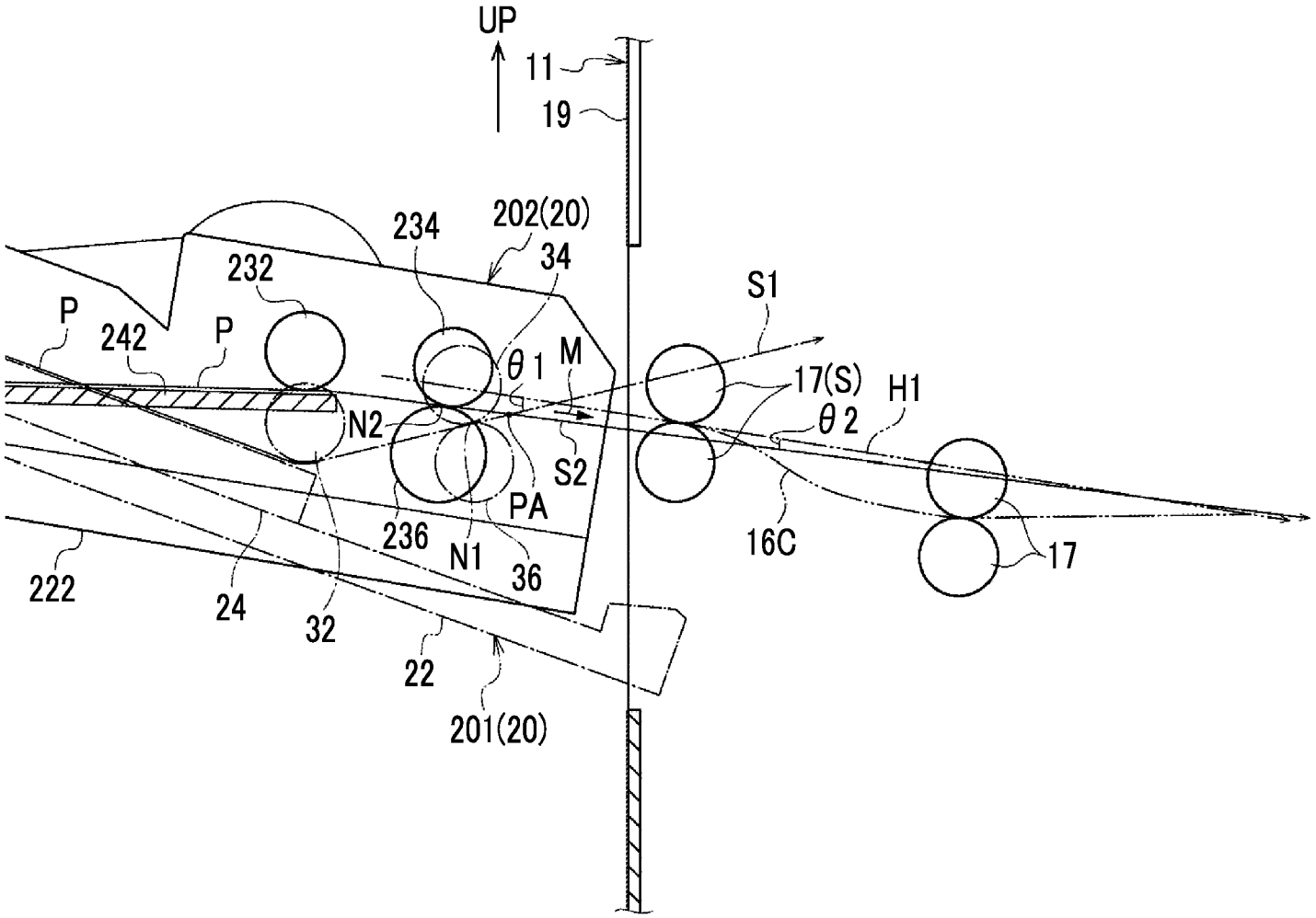
FIG. 12 is a side-sectional view for describing a difference between a feeding mechanism of the first manual feeding tray according to the present exemplary embodiment and a feeding mechanism of the second manual feeding tray according to the present exemplary embodiment.

As illustrated in FIG. 12, a nip position N1 between the transporting roller 34 and the applying roller 36 of the first manual feeding tray 201 is arranged at a position lower than a nip position N2 between the transporting roller 234 and the applying roller 236 of the second manual feeding tray 202. In the present exemplary embodiment, the nip position N1 is positioned on the downstream side in the feeding direction from the nip position N2. FIG. 12 illustrates a part of a configuration of each of the first manual feeding tray 201 and the second manual feeding tray 202.

In the first manual feeding tray 201, the recording media P stacked on the stacked portion 24 in a posture with a downward slope toward the downstream side in the feeding direction are fed in the first feeding direction S1 with an upward slope toward the downstream side in the feeding direction.

On the other hand, in the second manual feeding tray 202, the recording media P stacked on the stacked portion 224 in a posture with an upward slope toward the downstream side in the feeding direction are fed in the second feeding direction S2 with a downward slope toward the downstream side in the feeding direction.

As illustrated in FIG. 12, in side view, an acute angle θ2 formed by the second feeding direction S2 and the transporting direction H1 of the transporting member 17(S), which are described above, is smaller than an acute angle θ1 formed by the first feeding direction S1 and the transporting direction H1 of the transporting member 17(S), which are described above.

In addition, in the present exemplary embodiment, the first feeding direction S1 and the second feeding direction S2 intersect each other on the upstream side with respect to the transporting member 17(S), and the recording medium fed from the first manual feeding tray 201 changes a direction thereof toward the transporting member 17(S) after passing through the intersecting portion PA. After the direction change, the recording medium P heads for a direction (an arrow M direction) along the transporting direction H1.

The first feeding direction S1 is an intersecting direction (specifically, an orthogonal direction) with respect to a line connecting rotation centers of the transporting roller 34 and the applying roller 36 to each other, and is a direction passing through the nip position N1 between the transporting roller 34 and the applying roller 36.

The second feeding direction S2 is an intersecting direction (specifically, an orthogonal direction) with respect to a line connecting rotation centers of the transporting roller 234 and the applying roller 236 to each other, and is a direction passing through the nip position N2 between the transporting roller 234 and the applying roller 236.

The transporting direction H1 is an intersecting direction (specifically, an orthogonal direction) with respect to a line connecting rotation centers of a pair of transporting members 17(S) to each other, and is a direction passing through a nip position between the pair of transporting members 17(S). The nip position is a position where the recording medium P is pinched.

The feeding mechanism 30 of the first manual feeding tray 201 and the feeding mechanism 230 of the second manual feeding tray 202 are different in configuration as described hereinbefore.

Workings According to Present Exemplary Embodiment

In the present exemplary embodiment, it is possible to selectively mount the first manual feeding tray 201 and the second manual feeding tray 202 at the same mounting position on the image forming apparatus body 11.

Accordingly, it is possible to configure the image forming apparatus 10, for example, such that one of the first manual feeding tray 201 or the second manual feeding tray 202 is set as standard equipment, is mounted on the image forming apparatus body 11, and is replaced with the other one of the first manual feeding tray 201 or the second manual feeding tray 202 as optional equipment.

Herein, in a configuration (hereinafter, referred to as a configuration A) where the first manual feeding tray 201 and the second manual feeding tray 202 can be mounted at different mounting positions on the image forming apparatus body 11, it is necessary to provide a structure for mounting each of the first manual feeding tray 201 and the second manual feeding tray 202 at a plurality of positions, complicating the configuration.

On the other hand, since it is possible to selectively mount the first manual feeding tray 201 and the second manual feeding tray 202 at the same mounting position on the image forming apparatus body 11 as described above in the present exemplary embodiment, a degree of freedom in selecting a manual feeding tray to be mounted on the image forming apparatus body is increased with a simpler configuration than the configuration A.

In addition, in the present exemplary embodiment, the recording medium P, which is fed from the first manual feeding tray 201, and the recording medium P, which is fed from the second manual feeding tray 202, are transported to the image forming unit 14 on the same path in the transporting passage 16C.

Herein, in a configuration (hereinafter, referred to as a configuration B) where the recording medium P, which is fed from the first manual feeding tray 201, and the recording medium P, which is fed from the second manual feeding tray 202, are transported to the image forming unit 14 on different paths in in the transporting passage 16C, it is necessary to provide a plurality of paths, complicating the configuration of the transporting passage 16C.

On the contrary, since the recording medium P, which is fed from the first manual feeding tray 201, and the recording medium. P, which is fed from the second manual feeding tray 202, are transported to the image forming unit 14 on the same path in the transporting passage 16C in the present exemplary embodiment, the configuration of the transporting passage 16C is simpler than the configuration B.

In addition, in the present exemplary embodiment, as illustrated in FIG. 5, in the closed position, the first manual feeding tray 201 is stored inside the image forming apparatus body 11 (specifically, the housing 19). On the other hand, as illustrated in FIG. 10, in the closed position, the second manual feeding tray 202 is positioned outside the image forming apparatus body 11 (specifically, the housing 19).

For this reason, it is possible for the user of the image forming apparatus 10 to select the manual feeding tray 20 to be mounted on the image forming apparatus body 11 from the manual feeding trays 20 having storing forms different from each other in the closed position.

In addition, for example, 150 recording media P can be stacked on the stacked portion 24 of the first manual feeding tray 201 in the present exemplary embodiment. On the other hand, for example, 250 recording media P can be stacked on the stacked portion 224 of the second manual feeding tray 202 in the present exemplary embodiment. Therefore, the number of recording media that can be stacked on the second manual feeding tray 202 is larger than the number of recording media that can be stacked on the first manual feeding tray 201.

For this reason, it is possible for the user of the image forming apparatus 10 to select the manual feeding tray 20 to be mounted on the image forming apparatus body 11 from the manual feeding trays 20 having different numbers of recording media that may be stacked from each other.

In the present exemplary embodiment, the position of the stack surface 24E of the first manual feeding tray 201 in the height direction is fixed with respect to the tray body 22. On the contrary, since the stacked portion 224 of the second manual feeding tray 202 is pressed upward by the pressing member 229, the stack surface 224E on which the recording media P are stacked rises with a decrease in the number of stacked sheets.

For this reason, it is possible for the user of the image forming apparatus 10 to select the manual feeding tray 20 to be mounted on the image forming apparatus body 11 from the manual feeding trays 20 which are different from each other in terms of the presence or absence of a rise of the stack surfaces 24E and 224E.

In addition, in the present exemplary embodiment, the feeding mechanism 30 of the first manual feeding tray 201 and the feeding mechanism 230 of the second manual feeding tray 202 are different in configuration.

For this reason, it is possible for the user of the image forming apparatus 10 to select the manual feeding tray 20 to be mounted on the image forming apparatus body 11 from the manual feeding trays 20 having the feeding mechanisms 30 and 230 which are different in configuration.

In addition, in the present exemplary embodiment, as illustrated in FIG. 12, the nip position N1 between the transporting roller 34 and the applying roller 36 of the first manual feeding tray 201 is arranged at a position lower than the nip position N2 between the transporting roller 234 and the applying roller 236 of the second manual feeding tray 202.

For this reason, it is possible for the user of the image forming apparatus 10 to select the manual feeding tray 20 to be mounted on the image forming apparatus body 11 from the manual feeding trays 20 having different heights of the nip positions from each other.

In addition, in the present exemplary embodiment, as illustrated in FIG. 12, in side view, the acute angle θ2 formed by the second feeding direction S2 and the transporting direction H1 of the transporting member 17 (S) is smaller than the acute angle θ1 formed by the first feeding direction S1 and the transporting direction H1 of the transporting member 17(S).

Herein, in side view, in a configuration (hereinafter, referred to as a configuration C) where the acute angle θ2 formed by the second feeding direction S2 and the transporting direction H1 of the transporting member 17(S) is larger than the acute angle θ1 formed by the first feeding direction S1 and the transporting direction H1 of the transporting member 17(S), the acute angle θ1 is smaller than the acute angle θ2. Thus, the first feeding direction S1 forms an angle close to being parallel to the transporting direction H1 with a horizontal or downward slope. Accordingly, the inclination of the recording media P stacked on the first manual feeding tray 201 in a posture with a downward slope toward the downstream side in the feeding direction is steep. In addition, since the acute angle θ2 is larger than the acute angle θ1 in the configuration C, the second feeding direction S2 forms an angle close to being perpendicular to the transporting direction H1 with a horizontal or downward slope.

For this reason, in a case where the recording medium P transported from the second manual feeding tray 202 to the transporting passage 16C changes a direction toward the transporting member 17(S), a load applied to the recording medium P increases.

On the contrary, in the present exemplary embodiment, since the acute angle θ2 formed by the second feeding direction S2 and the transporting direction H1 of the transporting member 17 (S) is smaller than the acute angle θ1 formed by the first feeding direction S1 and the transporting direction H1 of the transporting member 17 (S) in side view as described above, the inclination of the recording media P stacked on the first manual feeding tray 201 in a posture with a downward slope toward the downstream side in the feeding direction is not excessively steep, and a load applied to the recording medium P transported from the second manual feeding tray 202 to the transporting passage 16C is small, compared to the configuration C.

In addition, in the present exemplary embodiment, the first feeding direction S1 and the second feeding direction S2 intersect each other on the upstream side with respect to the transporting member 17(S), and the recording medium fed from the first manual feeding tray 201 changes a direction thereof toward the transporting member 17(S) after passing through the intersecting portion PA.

Herein, in a configuration (hereinafter, referred to as a configuration D) where the recording medium P fed from the first manual feeding tray 201 changes a direction toward the transporting member before passing through the intersecting portion PA, the direction is changed immediately after passing through the nip position N1 between the transporting roller 34 and the applying roller 36. Thus, a load applied to the recording medium P transported from the first manual feeding tray 201 to the transporting passage 16C increases.

On the other hand, as described above, since the recording medium fed from the first manual feeding tray 201 changes a direction toward the transporting member 17 (S) after passing through the intersecting portion PA in the present exemplary embodiment, a load applied to the recording medium P transported from the first manual feeding tray 201 to the transporting passage 16C is smaller than the configuration D.

Modification Example

Although the recording medium P, which is fed from the first manual feeding tray 201, and the recording medium P, which is fed from the second manual feeding tray 202, are transported to the image forming unit 14 on the same path in the transporting passage 16C in the present exemplary embodiment, the invention is not limited thereto. For example, a configuration where the recording medium P, which is fed from the first manual feeding tray 201, and the recording medium P, which is fed from the second manual feeding tray 202, are transported to the image forming unit 14 on different paths in the transporting passage 16C may be adopted.

In addition, although the first manual feeding tray 201 and the second manual feeding tray 202 have storing forms different from each other in the closed position in the present exemplary embodiment, without being limited thereto, the first manual feeding tray and the second manual feeding tray may have the same storing form.

For example, a configuration where both of the first manual feeding tray 201 and the second manual feeding tray 202 are stored inside the image forming apparatus body 11 (specifically, the housing 19) in the closed position or a configuration where both are positioned outside the image forming apparatus body 11 (specifically, the housing 19) in the closed position may be adopted.

In addition, although the first manual feeding tray 201 and the second manual feeding tray 202 have different numbers of recording media that can be stacked from each other in the present exemplary embodiment, without being limited thereto, the first manual feeding tray and the second manual feeding tray may have the same number of recording media that can be stacked.

In addition, although the first manual feeding tray 201 and the second manual feeding tray 202 are different from each other in terms of the presence or absence of a rise of the stack surfaces 24E and 224E in the present exemplary embodiment, the invention is not limited thereto. For example, a configuration where the positions of the stack surface 24E of both of the first manual feeding tray 201 and the second manual feeding tray 202 in the height direction are fixed with respect to the tray body 22 or a configuration where the stack surface 224E on which the recording media P are stacked rises with a decrease in the number of stacked sheets may be adopted.

In addition, although the first manual feeding tray 201 and the second manual feeding tray 202 are different in configuration of the feeding mechanisms 30 and 230 in the present exemplary embodiment, without being limited thereto, the configurations of the feeding mechanisms 30 and 230 may be the same.

Although the nip position N1 between the transporting roller 34 and the applying roller 36 of the first manual feeding tray 201 is arranged at a position lower than the nip position N2 between the transporting roller 234 and the applying roller 236 of the second manual feeding tray 202 as illustrated in FIG. 12 in the present exemplary embodiment, the invention is not limited thereto. The nip position N1 may be at the same height as the nip position N2, or may be arranged at a position higher than the nip position N2.

In addition, although in side view, the acute angle θ2 formed by the second feeding direction S2 and the transporting direction H1 of the transporting member 17 (S) is smaller than the acute angle θ1 formed by the first feeding direction S1 and the transporting direction H1 of the transporting member 17(S) as illustrated in FIG. 12 in the present exemplary embodiment, without being limited thereto, the acute angle θ2 may be the same angle as the acute angle θ1, or may be larger than the acute angle θ1.

In addition, although the recording medium fed from the first manual feeding tray 201 changes a direction toward the transporting member 17(S) after passing through the intersecting portion PA in the present exemplary embodiment, the invention is not limited thereto. For example, a configuration where the recording medium P fed from the first manual feeding tray 201 changes the direction toward the transporting member before passing through the intersecting portion PA may be adopted.

The present invention is not limited to the exemplary embodiment, and various modifications, changes, and improvements can be made without departing from the gist thereof. For example, the plurality of modification examples described above may be configured in combination as appropriate.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a recording medium;

an image forming apparatus body in which the image forming unit is provided; and a first manual feeding tray and a second manual feeding tray having a configuration different from each other and being selectively mountable at a same mounting position on the image forming apparatus body, wherein the first manual feeding tray and the second manual feeding tray are different in configuration of feeding units that feed the stacked recording media to the image forming apparatus body, wherein one end portion of each of the first manual feeding tray and the second manual feeding tray is mounted at the mounting position so as to be openable and closable between a closed position and an open position with respect to the image forming apparatus body, the first manual feeding tray is stored inside the image forming apparatus body in the closed position, and the second manual feeding tray is positioned outside the image forming apparatus body in the closed position.

2. The image forming apparatus according to claim 1, further comprising:

a transporting passage that is formed in the image forming apparatus body and through which a recording medium fed from the first manual feeding tray and a recording medium fed from the second manual feeding tray are transported toward the image forming unit on a same path.

3. The image forming apparatus according to claim 2, wherein a number of the recording media that are able to be stacked on the second manual feeding tray is larger than a number of the recording media that are able to be stacked on the first manual feeding tray.

4. The image forming apparatus according to claim 3, wherein a position of a stack surface of the first manual feeding tray, on which the recording media are stacked, in a height direction is fixed, and a stack surface of the second manual feeding tray, on which the recording media are stacked, rises with a decrease in a number of stacked sheets.

5. The image forming apparatus according to claim 2, wherein a position of a stack surface of the first manual feeding tray, on which the recording media are stacked, in a height direction is fixed, and a stack surface of the second manual feeding tray, on which the recording media are stacked, rises with a decrease in a number of stacked sheets.

6. The image forming apparatus according to claim 1, wherein a number of the recording media that are able to be stacked on the second manual feeding tray is larger than a number of the recording media that are able to be stacked on the first manual feeding tray.

7. The image forming apparatus according to claim 6, wherein a position of a stack surface of the first manual feeding tray, on which the recording media are stacked, in a height direction is fixed, and a stack surface of the second manual feeding tray, on which the recording media are stacked, rises with a decrease in a number of stacked sheets.

8. The image forming apparatus according to claim 1, wherein a position of a stack surface of the first manual feeding tray, on which the recording media are stacked, in a height direction is fixed, and a stack surface of the second manual feeding tray, on which the recording media are stacked, rises with a decrease in a number of stacked sheets.

9. The image forming apparatus according to claim 1, wherein feeding units of the first manual feeding tray and the second manual feeding tray each have a transporting roller that transports the recording medium to the image forming apparatus body and a facing roller that is arranged to face the transporting roller and pinches the recording medium with the transporting roller, and a pinching position between the transporting roller and the facing roller of the first manual feeding tray is arranged at a position lower than a pinching position between the transporting roller and the facing roller of the second manual feeding tray.

10. An image forming apparatus comprising:

an image forming unit that forms an image on a recording medium;

an image forming apparatus body in which the image forming unit is provided;

a first manual feeding tray and a second manual feeding tray having a configuration different from each other and being selectively mountable at a same mounting position on the image forming apparatus body;

a transporting passage that is formed in the image forming apparatus body and through which a recording medium fed from the first manual feeding tray and a recording medium fed from the second manual feeding tray are transported toward the image forming unit; and a transporting member that is arranged on a most upstream side in the transporting passage and transports the recording medium in a transporting direction with a horizontal or downward slope, wherein the recording media are stacked on the first manual feeding tray in a posture with a downward slope toward a downstream side in a feeding direction in which the recording medium is fed from the first manual feeding tray, the recording medium is fed from the first manual feeding tray to the transporting member in a first feeding direction with an upward slope toward the downstream side in the feeding direction, the recording media stacked on the second manual feeding tray are fed from the second manual feeding tray to the transporting member in a second feeding direction with a downward slope toward the downstream side in the feeding direction, and in side view, an acute angle formed by the second feeding direction and the transporting direction is smaller than an acute angle formed by the first feeding direction and the transporting direction.

11. The image forming apparatus according to claim 10, wherein the first feeding direction and the second feeding direction intersect each other on an upstream side with respect to the transporting member, and the recording medium fed from the first manual feeding tray changes a direction thereof toward the transporting member after passing through the intersecting portion.

* * * * *